US005227594A

United States Patent [19]

Russo

[11] Patent Number: 5,227,594

[45] Date of Patent: Jul. 13, 1993

[54] ELECTRICAL MULTI-DIRECTIONAL SWITCH

[75] Inventor: Louis G. Russo, Marengo, Ill.

[73] Assignee: Guardian Electric Manufacturing Company, Woodstock, Ill.

[21] Appl. No.: 806,164

[22] Filed: Dec. 12, 1991

[51] Int. Cl.[5] ..... H01H 25/04

[52] U.S. Cl. ..... 200/6 A

[58] Field of Search ..... 200/5 R, 5 A, 6 A, 18; 74/471 XY

[56] References Cited

U.S. PATENT DOCUMENTS

| | | | |
|---|---|---|---|
| 3,198,892 | 8/1965 | Barcus et al. | 200/6 R |
| 3,293,381 | 12/1966 | Eitel | 200/6 A |
| 3,401,240 | 9/1968 | Groves | 200/6 A |
| 3,917,918 | 11/1975 | Vannest et al. | 200/6 A |
| 4,029,915 | 6/1977 | Ojima | 200/5 A |
| 4,181,827 | 1/1980 | Diepeveen | 200/6 A |
| 4,308,434 | 12/1981 | Roeser | 200/6 R |
| 4,349,708 | 9/1982 | Asher | 200/6 A |
| 4,382,166 | 5/1983 | Kim | 200/6 A |
| 4,414,438 | 11/1983 | Maier et al. | 200/6 A |
| 4,511,769 | 4/1965 | Sahakian et al. | 200/6 A |
| 4,520,242 | 5/1985 | Kopsho, Jr. | 200/6 A |
| 4,584,443 | 4/1986 | Yaeger | 200/6 A |
| 4,749,826 | 6/1988 | Saito | 200/6 A |

*Primary Examiner*—J. R. Scott

*Attorney, Agent, or Firm*—Allegretti & Witcoff, Ltd.

[57] ABSTRACT

An electrical, multi-directional manual switch. The switch includes a central, pivoting arm and a plurality of sub-miniature switches positioned about the arm. The compact configuration of the sub-miniature switches allows one or more of the switches to be activated simply by pivoting the arm. Moreover, a plurality of the sub-miniature switches may be activated substantially simultaneously by a single pivoting movement of the arm. This allows the switch to continue working, even if one or more of the sub-miniature switches should fail. Alternatively, the sub-miniature switches may be arranged in a variety of different configurations about the arm so that the arm will activate different sub-miniature switches when pivoted in a variety of different directions or when depressed.

4 Claims, 5 Drawing Sheets 32
61
22
40
43
42b
42c
42a
42d
36
34
86
30
88
48
20
52
44
54
56
24
26
62
64
46
46
58
60
28
50
68
70
66
78
76
86
72
38
74
82
84
80

Fig. 6
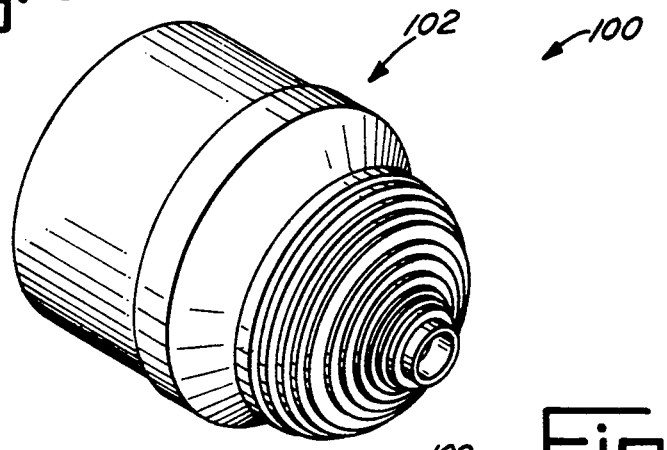
Fig. 8
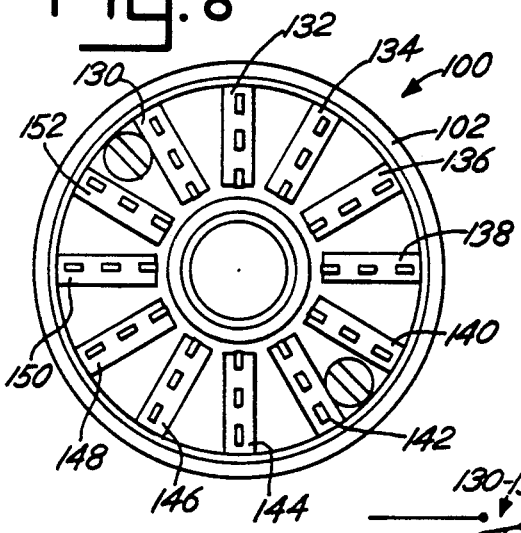
Fig. 7
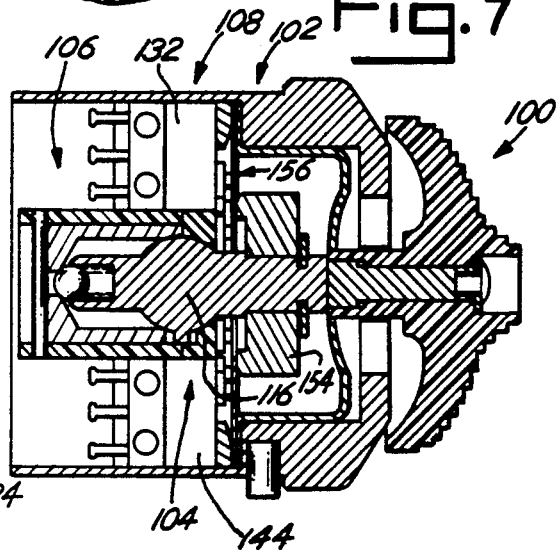
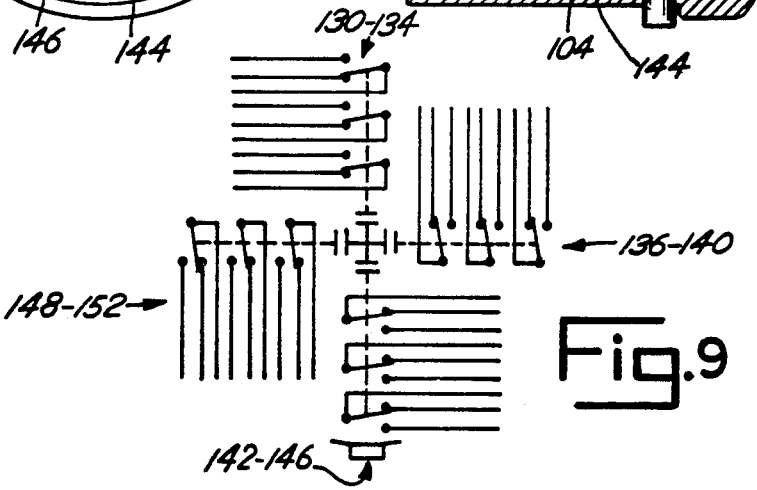
Fig. 9

100
108
102
130
108
112
114
104
118
116
120
106
126
128
154
110
158
156
164
160
162

ELECTRICAL MULTI-DIRECTIONAL SWITCH

BACKGROUND OF THE INVENTION

The present invention relates generally to electrical switches and, more particularly, to an electrical, multipole, multi-directional manual switch. A variety of equipment requires instructions in the form of electrical signals from switches. Often, the switches may be moved in a variety of different directions to instruct a machine (such as an aircraft) how to perform. Such switches may be mounted, for example, on joy sticks for easy manual operation.

In many environments, such as an aircraft cockpit, the space available for switches is limited. Accordingly, a switch should be compact. Moreover, the switch must be reliable, since the malfunctioning of a switch could cause equipment failure and injury.

Furthermore, such switches must be ergonometrically adapted for easy and reliable use by a human operator. Also, since some operators require their equipment to respond quickly to manual pressure on the switches, the physical movement necessary to activate a switch should be small, but must still be large enough to allow the operator to manually "feel" when a switch has been "thrown."

In addition, the switches should be capable of being mass-produced, so that they can be manufactured at a lower cost. Also, the switches should have a small "parts count," since this will tend to increase their reliability and decrease their cost. Since the switches are used in a variety of applications, the switches should, if possible, be adapted for use in a variety of different applications.

SUMMARY OF THE INVENTION

In a principal aspect, the present invention is an electrical switch assembly. The switch includes a housing, arm, centering mechanism, plurality of switches, and an actuator. The arm is pivotally connected inside the housing to move from side to side within the housing. The centering mechanism urges the arm toward a rest position. The switches are positioned within the housing about the pivoting arm. Each of the switches about the arm defines rest and activated states.

The actuator is adjacent the arm and moves in response to the pivoting of the arm. When the arm pivots, the actuator moves against at least one of the switches and changes the state of the switch from, for example, "off" to "on."

In one embodiment, the actuating arm includes a distal end. The distal end is located within the housing, next to another switch. Depressing the actuating arm changes the state of the additional switch. Thus, in this configuration, the arm within the switch assembly can activate different switches both by pivoting as well as by being depressed.

In another embodiment, the actuator includes a substantially flexible plate which flexes against one or more of the switches when the arm pivots. The plate includes a plurality of contoured flexing segments that define what switches are activated when the arm pivots.

Thus, an object of the present invention is an improved electrical switch assembly. Another object in a multi-directional switch that is more compact and more reliable. A further objective is a multi-directional switch which has a lower parts count and is less expensive to manufacture.

Still another object is a multi-directional switch that is easier for an operator to use. Yet another object is a multi-directional switch that is more compact and still includes redundant switches for safety. A still further object is multi-directional switch that is more economical to manufacture.

Still another object is multi-directional switch having a housing that can accommodate a greater variety of switches in different configurations. A further object is a more compact, multi-directional switch that may activate different machinery when pivoted in a greater number of directions. Still another object is a more compact multi-directional switch that may also activate machinery when a pivoting arm is depressed. These and other objects, features, and advantages of the present invention are discussed or are apparent in the following detailed description.

BRIEF DESCRIPTION OF THE DRAWING

Preferred embodiments of the present invention are described herein with reference to the drawing wherein:

FIG. 6 is an isometric view of a second preferred embodiment of the present invention;

FIG. 7 is a cross-sectional view of the preferred embodiment shown in FIG. 6, taken along line 7—7;

FIG. 8 is a bottom view of the preferred embodiment shown in FIG. 6;

FIG. 9 is a schematic diagram of the switches in the preferred embodiment shown in FIG. 6;

DETAILED DESCRIPTION OF THE PREFERRED EMBODIMENTS

Figure 1:
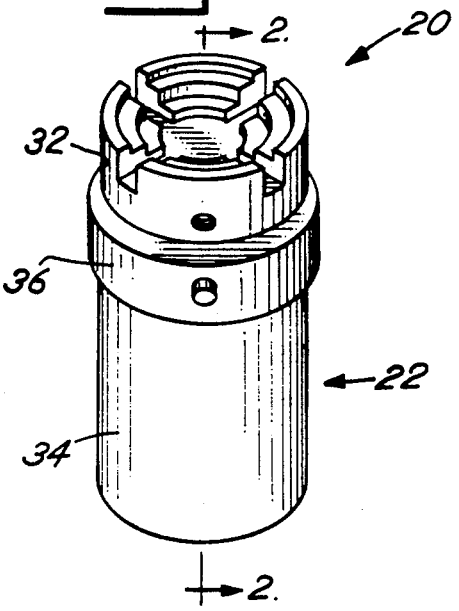
FIG. 1 is an isometric view of a preferred embodiment of the present invention.
Figure 2:
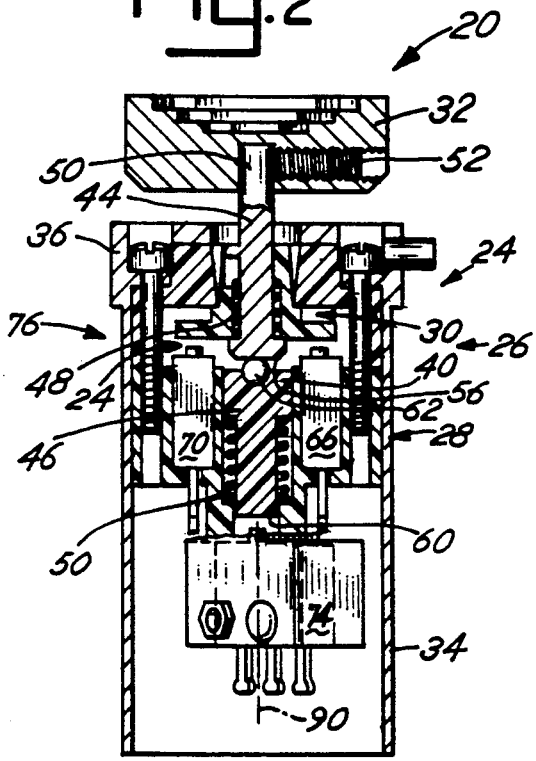
FIG. 2 is a cross-sectional view of the preferred embodiment shown in FIG. 1, taken along line 2—2.
Figure 4:
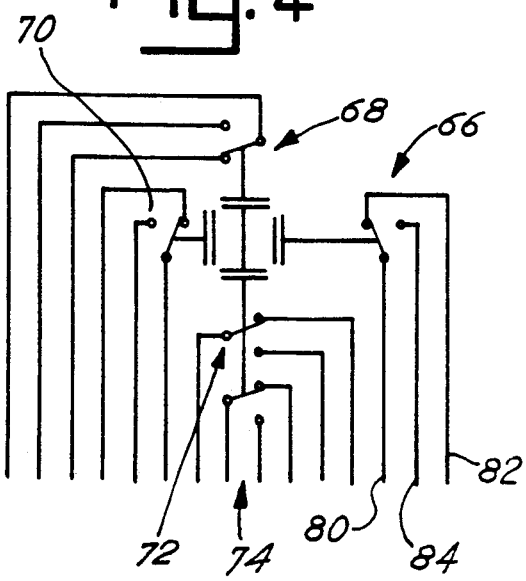
FIG. 4 is a schematic diagram of the switches in the preferred embodiment shown in FIG. 1.
Figure 3:
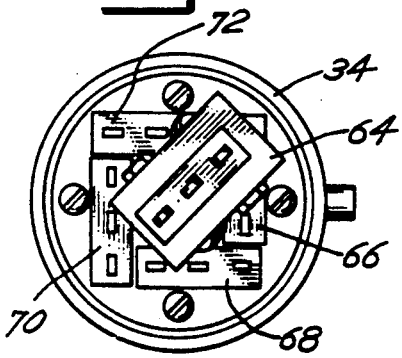
FIG. 3 is a bottom view of the preferred embodiment shown in FIG. 1.
Figure 5:
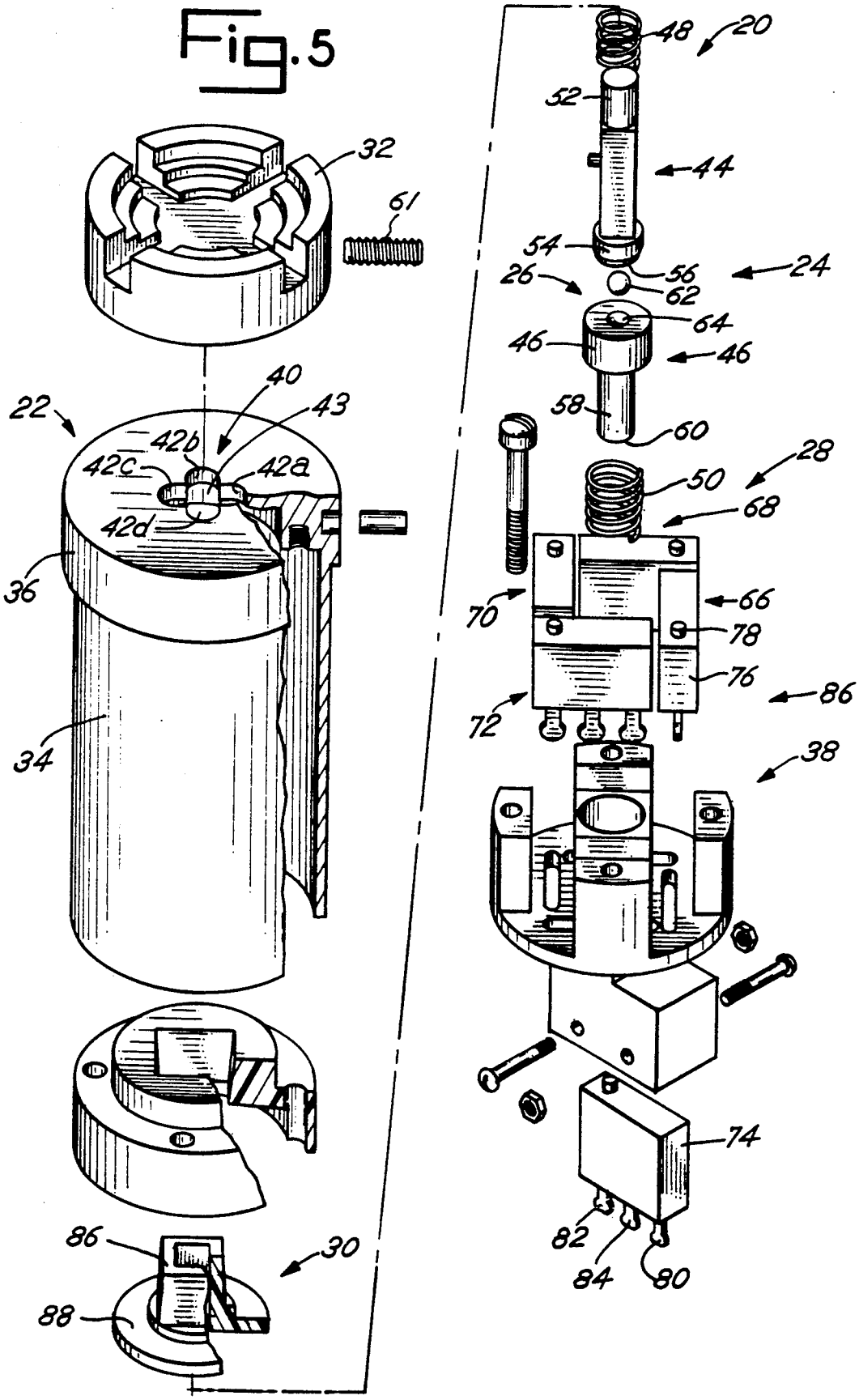
FIG. 5 is an exploded view of the preferred embodiment shown in FIG. 1.
Figure 10:
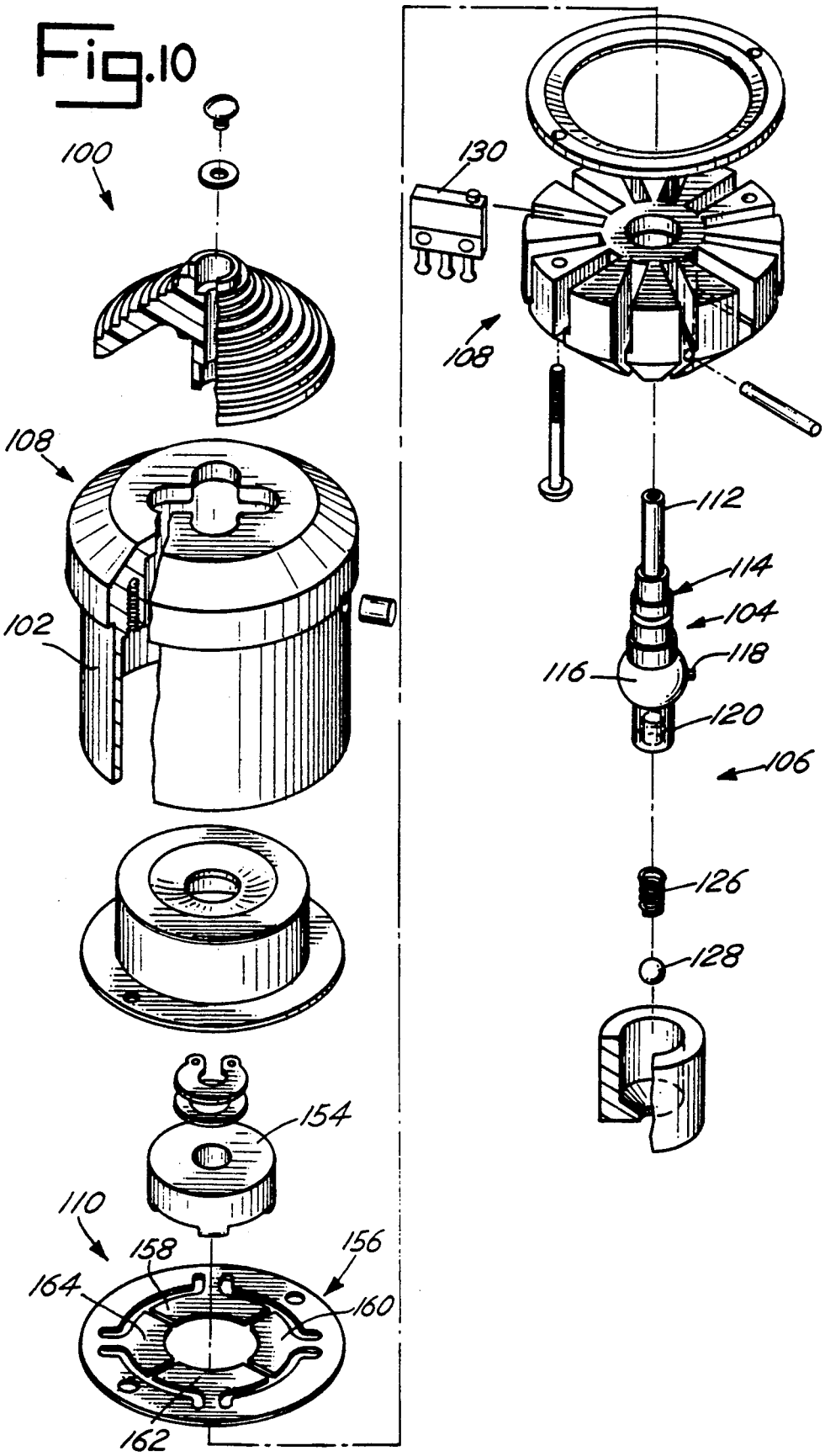
FIG. 10 is an exploded view of the preferred embodiment shown in FIG. 6.

Referring to FIGS. 1–11, the present invention is a multi-directional switch. Referring to FIGS. 1, 2, and 5, a multi-directional switch 20 with movement in all three dimensions is shown. The switch 20 includes a housing 22, arm 24, centering mechanism 26, primary switch assembly 28, actuator 30, and thumb button 32.

As shown in FIGS. 1 and 5, the housing 22 includes an outer shell 34, a cap 36, and a central frame 38. As shown in FIGS. 2 and 5, the housing 22 holds the multi-directional switch 20 together. The arm 24, centering mechanism 26, primary switch assembly 28, and actuator 30 are all substantially positioned within the housing 22.

Much of the arm 24 is substantially retained within the shell 34 of the housing 22 by the cap 36. The cap 36 includes a cross-shaped cut-out 40 to provide a guide for movement of the arm 24. See FIG. 5. The cut-out 40 defines four activated positions 42*a, b, c, d* to which the arm 24 may be pivoted and a central rest position 43. In the preferred embodiments shown in FIGS. 1-11, the arm 24 may be pivoted only in four directions.

The arm 24 includes a pivoting section 44 partially extending out of the housing 22, an internal section 46 within the housing 22, a positioning spring 48 that extends around the pivoting section 44 of the arm 24 and that is adjacent the housing cap 36, and a compression spring 50. The pivoting section 44 of the arm 24 includes an upper segment 52 adjacent the thumb button 32 and a lower segment 54 that is adjacent the positioning spring 48. The lower segment 54 has a substantially flat, distal end 56.

The internal section 46 of the arm 24 includes an upper segment 57 adjacent the pivoting section 44 of the arm 24 and a lower segment 58 that has a substantially flat, distal end 60. The compression spring 50 extends around the lower segment 58 of the external section 46 of the arm 24 and is adjacent the frame 38. The thumb button 32 is fixedly attached to the upper section 52 of the pivoting section 44 of the arm 24 and held in place by a screw 61.

The centering mechanism 26 is cooperatively defined by a ball bearing 62, a rounded depression 64 in upper segment 57 of the internal section 46 of the arm 24, the lower segment 54 of the pivoting section 44 of the arm 24, the positioning spring 48, and the compression spring 50. The centering mechanism 26 maintains the pivoting section 44 of the arm 24 in a substantially central, rest position within the housing 22, as shown in FIG. 2. The positioning spring 48 urges the pivoting section 44 of the arm 24 back to the central, rest position within the housing 22 after the pivoting section 44 is manually pivoted to one of the activated positions 42*a*–42*d* dictated by the cut-out 40. The compression spring 50 urges the internal section 46 and, necessarily, the pivoting section 44 of the arm 24 back to the central, rest position (as shown in FIG. 2) after the ram 24 is depressed (rather than pivoted).

In the preferred embodiment shown in FIGS. 1-5, the primary switch assembly 28 includes four primary switches 66, 68, 70, 72, arranged in a box configuration about the arm 24, and an additional push switch 74 positioned in the housing 22 substantially adjacent the flat, distal end 60 of the lower segment 58 of the internal section 46 of the arm 24. Accordingly, when the arm 24 is depressed against the compression spring 50, the flat, distal end 60 presses against the additional push switch 74.

Each of the switches 66–74 is substantially identical, and one exemplary switch 74 is discussed below for purposes of illustration. The switch 74 is a sub-miniature, double-break, snap-action switch. The sub-miniature switch 74 includes a central body 76, an actuating button 78 and first, second and third leads 80, 82, 84. See FIG. 5. Depressing the actuating button 78 moves contacts (not shown) within the housing 76 of the switch 74, changing the state of the switch 74. In such a case, current no longer flows between first and second leads 80, 82 but, instead, between first and third leads 80, 84. See FIG. 4.

As shown in FIG. 5, the actuator 30 includes a neck section 86 and a plate section 88. The plate section 88 extends radially about from the arm 24, substantially orthogonal to a central axis 90 defined by the arm 24 and the housing 22. See FIG. 2. In its rest position, the actuator 30 maintains a central position such that neither the collar 46 or any other part of the actuator 30 is pressed against an actuating button of any primary switch 66–72 or of the additional push switch 74.

When the pivoting section 44 of the arm 24 is pivoted to one of the positions 42*a*–*d* defined by the cut-out 40, however, the actuator 30 is pressed against the actuating button of one of the switches 66–72, causing the switch to change contact connections. Current then flows between first and third leads rather than the first and second leads. When the arm 24 is depressed, the pivoting section 44 presses the internal section 46, and the flat end of the external section 46 presses against the actuating button 78 of the push switch 74.

The arm 24 can only be depressed when the arm 24 in a position substantially parallel to the central axis 90 of the housing 22. In this way, the actuator 30 is prevented from pressing against any of the actuating buttons of the primary switches 68–72 when the arm 24 is depressed against the push switch 74. The neck section 86 of the actuator 30 and the central frame 38 of the housing cooperatively define a guide 86. The guide 86 prevents the pivoting section 44 of the arm 24 from pressing against the internal section 46 of the arm 24 unless the pivoting section 44 is in a central location within the housing 22, substantially co-linear with the central axis 90 of the housing 22.

A second preferred embodiment of the present invention is shown in FIGS. 6–11 as a multi-directional switch 100. As with the embodiment shown in FIGS. 1-5, the switch 100 shown in FIGS. 6–11 includes a housing 102, pivoting arm 104 within the housing 22, centering mechanism 106, a primary switch assembly 108, an actuator 110, and a frame 111. No additional push switch, however, is located within the housing 102.

The arm 104 includes a proximate end 112, neck 114, bulbous central portion, 116, protruding pin 118, and distal end 120. The frame 111 includes a funnel-shaped depression 122 and a rounded cavity 124. The bulbous central portion 116 of the arm 104 is cradled by the rounded cavity 124 of the frame 111 and allows the arm 104 to pivot. The protruding pin 118 prevents unwanted rotation of the arm 104.

The centering mechanism 106 includes a spring 126 and a ball bearing 128. The spring 126 urges the bearing 128 and distal end 120 of the arm 104 toward the middle of the depression 122, thus urging the arm 104 toward a substantially central location within the housing 22.

The bulbous central portin 116 of the arm 104 is cradled by the housing 102 and allows the arm 104 to pivot. The protruding pin 118 extends into the housing 102 to prevent unwanted rotation of the arm 104.

The primary switch assembly 108 includes twelve sub-miniature switches 130, 132, 134, 136, 138, 140, 142, 144, 146, 148, 150, 152. Each of the twelve switches 130–152 is substantially identical to the sub-miniature switches 56–74 previously described. In the preferred embodiment shown in FIGS. 6–11, the arm 104 may be only pivoted in four directions defined by a cut-out 154 in the housing 22.

In the preferred embodiment shown in FIG. 6, the twelve switches are divided into three sets of four switches each, designated as switches 130–134, 136–140, 142–146, and 148–152. Each set of three switches is in a parallel electrical configuration. In this way, even if one or two of the switches of each set fail to function, the third switch of the set will continue to function, allowing switch 100 to continue operation. See FIG. 9.

The actuator 110 of the embodiment shown in FIGS. 6–11 includes a cap 154 and a flexible plate 156. The flexible plate 156 includes a base ring 158 and four flexing segments, 160, 162, 164, 166. The flexing segments 160–166 each include a flexing neck 168, 170, 172, 174, and a contoured contacting section 176, 178, 180, 182.

When the arm 104 is pivoted, the substantially rigid cap 154 presses in the direction in which the arm 104 is pivoted, causing one of the flexing segments 160–166 to move toward one set of the switches 130–152 in response to the pivoting of the arm 104. The flexing segment responsively extends toward and press against the actuating buttons of one of the four sets of three switches 130–134, 136–140, 142–146, and 148–152. The flexing segment then changes the states of the three switches in the set substantially simultaneously.

Figure 11:
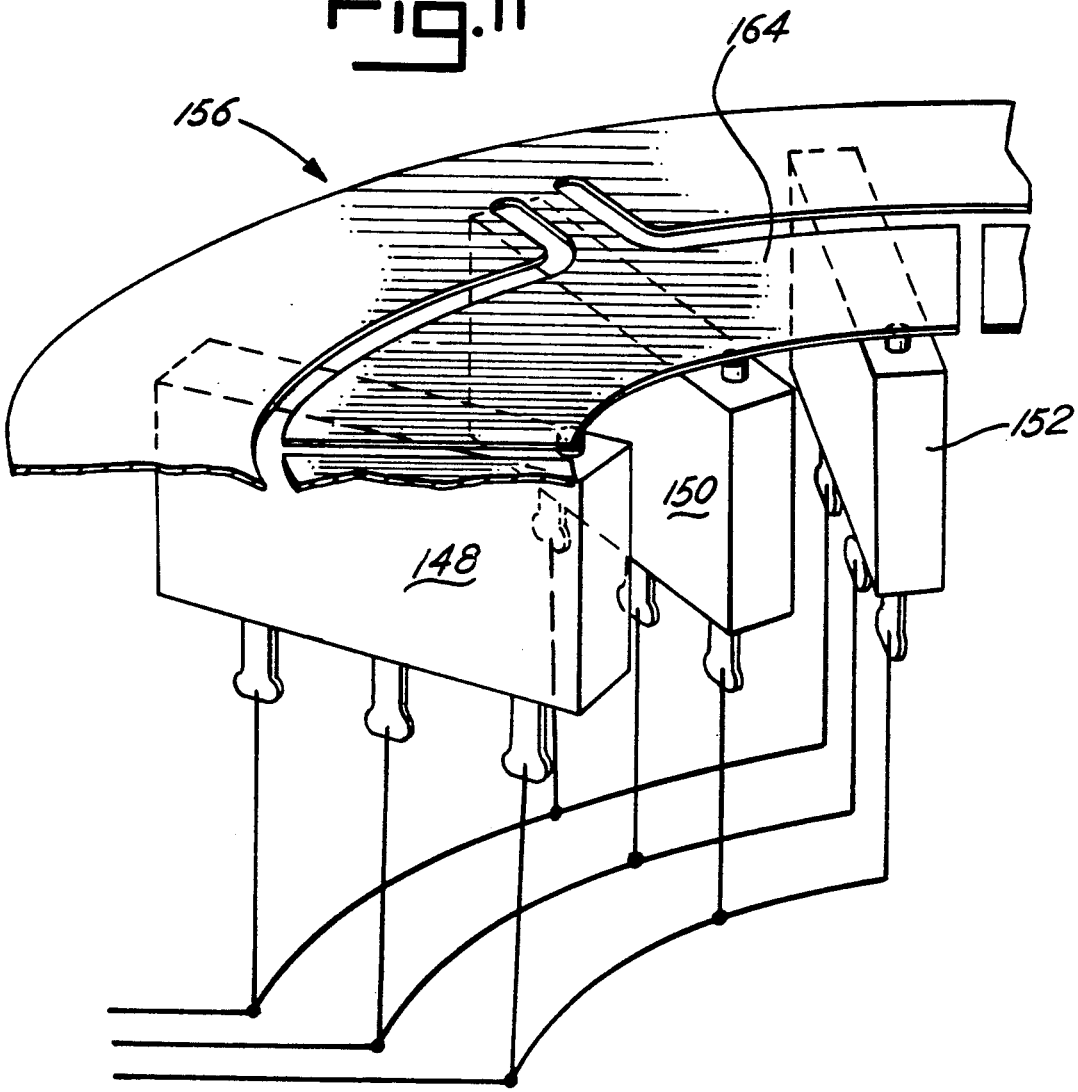
FIG. 11 is a partial isometric view of a portion of the actuator and switches of the preferred embodiment shown in FIG. 6.

Two preferred embodiments of the present invention have been described herein. It is to be understood, of course, that changes and modifications may be made in the embodiments without departing from the true scope and spirit of the present invention, as defined by the appended claims. Thus, for example, the actuator 110 of the present invention could be divided into a different number of flexing segments (such as three or eight), providing for a different number of directions that the pivoting arm 104 could be pivoted in order to a activate a switch. FIG. 11 illustrates an actuating means for activating three switches substantially simultaneously.

What is claimed is:

1. An electrical switch assembly comprising, in combination:

a housing;

a pivoting arm extending both inside and outside of said housing, said arm defining normal and pivoted positions;

centering means for urging said arm toward said normal position;

a plurality of primary switches positioned within said housing and about said arm, each of said switches defining first and second states;

an actuator within said housing, substantially adjacent said arm and switches, said actuator including a base and a plurality of resilient flexing segments, said flexing segments defining normal positions when said pivoting arm is in said normal position, said base and flexing segments being substantially planar when said pivoting arm is in said normal position, and one of said flexing segments being pressed toward said primary switches by said pivoting arm to a flexed position with respect to said base when said arm is in said pivoted position, said one flexing segment pressing against at least two of said primary switches and substantially simultaneously changing states of said two primary switches in response to said arm pivoting.

2. An electrical switch assembly as claimed in claim 1 wherein said two primary switches pressed by said flexing segment are wired in a parallel electrical configuration, whereby reliability of said electrical switch assembly is increased.

3. An electrical switch assembly as claimed in claim 2 wherein each of said primary switches is a unitary switch that includes an actuating pin wherein movement of an actuating pin in each of said switches changes said state of said switch.

4. An electrical switch assembly as claimed in claim 3 wherein a plurality of said primary switches is radially spaced about said actuating arm.

* * * * *